United States Patent [19]

Dubreux et al.

[11] Patent Number: 4,810,408

[45] Date of Patent: Mar. 7, 1989

[54] METHOD AND COMPOSITION FOR BLEACHING LAUNDRY

[75] Inventors: Bernard Dubreux, Francheville Le Bas; Françoise Chosson, Millery, both of France

[73] Assignee: Atochem, France

[21] Appl. No.: 49,130

[22] Filed: May 12, 1987

[30] Foreign Application Priority Data

May 15, 1986 [FR] France ..... 86 07150

[51] Int. Cl.[4] ..... C11D 3/39; C11D 7/18

[52] U.S. Cl. ..... 252/99; 252/102; 252/103; 252/186.4

[58] Field of Search ..... 252/186.4, 102, 103, 252/99

[56] References Cited

U.S. PATENT DOCUMENTS 3,897,347 7/1975 Eckert ..... 252/8.85

4,623,357 11/1986 Urban ..... 8/107

*Primary Examiner*—John F. Niebling

*Assistant Examiner*—Isabelle Rodriquez

*Attorney, Agent, or Firm*—Sigalos, Levine & Montgomery

[57] ABSTRACT

Bleaching of laundry using a peroxidized compound is carried out at a temperature of less than 70° C. for less than 30 minutes in a bath which has a pH of 10.5 to 12.5 in the presence of $1\times10^{-3}$ to $1\times10^{-2}$ gram-atom of calcium or of barium per liter of bath and of a sequestrant for alkaline earth metal ions in a quantity equal or superior to that which corresponds to the sequestration of calcium or barium ions in solution in the bath; the calcium or the barium being introduced in the form of the oxide CaO or BaO; the hydroxide $Ca(OH)_2$ or $Ba(OH)_2$; or of a salt, the anion of which is inert towards hydrogen peroxide and which is accompanied by a quantity of sodium hydroxide equal to that required for the formation of calcium hydroxide or barium hydroxide.

12 Claims, No Drawings

METHOD AND COMPOSITION FOR BLEACHING LAUNDRY

BACKGROUND OF THE INVENTION

The present invention relates to the bleaching of laundry using a peroxidized compound.

Within the scope of the invention, the peroxidized bleaching agent may usually be hydrogen peroxide, persalts or peroxyhydrates. The latter compounds, in addition to being expensive carriers of active oxygen and hydrogen peroxide are unfortunately not sufficiently effective at a temperature of less than approximately 70° C.

Therefore, it becomes essential to add to them, as in the case of hydrogen peroxide, an activator such as tetraacetylethylenediamine (TAED), tetraacetylglycoluryl (TAGU) or α-acetoxy-α-methyl-N,N'-diacetylmalonamide (AP31) described in the French Pat. No. 2,363,541, among others.

These activators, the synthesis and the form of production of which are expensive, are a great burden on the profitability of bleaching.

British patent application No. 2,149,418 describes a method which does not involve the use of such an activator, but, according to which when calcium is present, even in small amounts, it is necessary to use a sodium carbonate-divalent maganese ion pair and a sequestrant which must become active only when the bath has reached at least a particular stage known as the critical stage.

SUMMARY OF THE INVENTION

The method and composition of the invention achieve very high bleaching effects while avoiding the disadvantages relating to the cost and complexity of known methods and composition and avoid the use of complex activators or the need for the bath to pass through a stage; which is evaluated indirectly, making it likely to lead to unreliable results.

Briefly, the invention is characterized in that bleaching of laundry using a peroxidized compound is carried out at a temperature of less than 70° C. for less than 30 minutes in a bath which has a pH of 10.5 to 12.5 in the presence of $1.10^{-3}$ to $1\times10^{-2}$ gram atom of calcium or of barium per liter of bath and of a sequestrant for alkaline earth metal ions in a quantity equal or superior to that which corresponds to the sequestration of calcium or barium ions in solution in the bath; the calcium or the barium being introduced in the form of the oxide CaO or BaO; the hydroxide $Ca(OH)_2$; or of a salt, the anion of which is inert towards hydrogen peroxide and which is accompanied by a quantity of sodium hydroxide equal to that required for the formation of calcium hydroxide or barium hydroxide.

DETAILED DESCRIPTION

The most useful results, from the point of view of the reliability of the method, are obtained at a bath temperature of at least about 30° C. Below 30° C., the improvement observed in the bleaching effect decreases indeed rapidly. The temperature should not exceed 70° C.

A bath pH limited to approximately 11.5 is also preferred, as a risk of degradation of the cellulose fiber may become apparent above this value.

Within the range mentioned for the quantity of calcium or barium employed, a quantity at least equal to $5\times10^{-3}$gram-atom per liter of bath is most frequently preferred.

When calcium and barium are used in the form of a salt, they are chosen preferably from amongst salts with a high solubility; such as, in particular, chloride.

The sequestrants for alkaline earth metal ions used in the method of the invention are chosen, for example, from amongst the alkali metal salts of polyphosphoric acids such as sodium tripolyphosphate (hereinafter called NaTPP); alkali metal salts of polyaminecarboxylic acids or of polyoxycarboxylic acids, such as those of ethylenediaminetetraacetic acid, pentasodium salt of diethylenetriaminepentaacetic acid (hereinafter called 5NaDTPA); trisodium salt of nitrilotriacetic acid (hereinafter called 3NaNTA); sodium citrate.

NaTPP is particularly well suited for implementing the invention.

The peroxidized bleaching agent is selected from peroxidized compounds with bleaching action commonly employed until now, such as hydrogen peroxide, sodium perborate, sodium percarbonate or urea peroxyhydrate. The corresponding active oxygen concentration in the bath in the presence of these peroxidized compounds is generally between about 0.004% and 0.03% by weight.

The bath may further contain, as is generally the case in practice, in type and in quantity, all or some of the products known to be usually present in a bath with detergent action, such as the surfactants and builders: alkylbenzenesulphonates, alkylarylbenzenesulphonates, oxyethylenated fatty alcohols; anti-resettling agents; blueing agents; perfumes and the like. Known detergents are given, for example in DETERGENT MANUFACTURE by Marshall Sittig, Noyes Data Corporation, 1976.

The duration of the operation according to the invention is generally between approximately 10 minutes and 30 minutes.

The preparation of the bath may be carried out in any way, bringing its constituents together in any sequence. For example, the alkaline earth element; calcium or barium, accompanied, where appropriate, by the desired amount of sodium hydroxide, may be added to the other constituents, including the sequestrant, solubilized in water prior to this addition.

Simultaneous addition of the constituents to prepare a bath for bleaching laundry using a peroxidized compound in a bath may be carried out by means of the other subject of the invention, which is a composition containing a peroxidized bleaching agent, characterized in that it contains calcium or barium in the form of the oxide, the hydroxide or a salt, the anion of which is inert towards hydrogen peroxide, and which is accompanied by a quantity of sodium hydroxide equal to that required for the formation of calcium hydroxide or barium hydroxide, and a sequestrant for alkaline earth metal ions; the respective quantities of calcium or barium, of sodium hydroxide where appropriate, and of sequestrant being such that they make it possible to prepare a bath with a pH between 10.5 and 12.5, containing from $1\times10^{-3}$ to $1\times10^{-2}$ gram-atom of calcium or of barium per liter, in which the calcium or barium ions in solution are sequestered. Such a composition may also contain in type and in quantity all or some of the products known to be usually present in a bath with detergent action and such as those mentioned above.

In practice, a composition according to the invention is such that the quantity of peroxidized bleaching agent it contains leads to an active oxygen concentration in the bath; for the preparation of which it is intended, of between 0.004% and 0.03% by weight.

The treatment according to the invention is followed by operations of rinsing and spin-drying, before drying, as carried out in conventional methods.

The invention will be further described in connection with the following examples which are set forth for purposes of illustration only.

In these twelve examples:

(i) the term "washing powder" is used to denote an EMPA ® standardized washing powder containing, by weight, 14% of surfactants, 30.4% of sodium tripolyphosphate, the remaining constituents required to make up 100% comprising sodium pyrophosphate, sodium orthophosphate and other sodium salts, as well as blueing agents, miscellaneous compounds and 18.9% of water, (ii) the method of the invention is carried out in a stirred cylindrical tank made of glass, equipped with a heating means and containing the bath and an EMPA ® standardized fabric, which is stained with wine, in a bath/fabric weight ratio of 100. Such a high ratio was chosen only for reasons of convenience. It is not a parameter with practical consequence on the result of the method, (iii) the washing-bleaching operation comprises a temperature plateau of 15 minutes. Only the value of this temperature will hereinafter be mentioned. The time required for the bath temperature to rise from ambient temperature to approximately 20° C. is 6, 4 and 2 minutes when the plateau temperature is 80° C., 60° C., and 40° C., respectively. At the end of the operation, the treated fabric is separated from the bath in the conventional way, drained and rinsed with water at ambient temperature before drying, (iv) the degree of whiteness of the fabric is determined using an ERICHSEN GLOSSMASTER No. 507 spectrophotometer calibrated, using the magnesium oxide supplied as standard with the apparatus, to give a degree of whiteness of 90, (v) the fabric to be treated has a measured degree of whiteness of 41, and (vi) each time, the pH of the bath is between 10.5 and 12.5.

The characteristics of the twelve examples and the results obtained for each of them are collated in Table I below.

It has been verified that the replacement of sodium perborate with hydrogen peroxide in the examples does not alter the whiteness obtained as a result.

From an examination of Table I, it is possible to ascertain that; to reach a given degree of whiteness, 70% less peroxidized bleaching agent is consumed when the method followed is that of Example 2 according to the invention and not according to Example 5 which does not incorporate the invention.

A comparison of Examples 2 and 5 shows a more than 20% improvement in the degree of whiteness at 60° C., by virtue of the application of the invention. A comparison of Examples 10 and 11 shows that even at 40° C., there is an improvement of 15% in the degree of whiteness.

A comparison of Examples 1 and 12 shows that by following the procedure according to the invention, the temperature required for achieving a given degree of whiteness can be approximately 20° C. below that required when the invention is not applied.

While the invention has been described in connection with a preferred embodiment, it is not intended to limit the scope of the invention or the particular form set forth, but, on the contrary, it is intended to cover such alternatives, modifications, and equivalents as may be included within the spirit and scope of the invention as defined by the appended claims.

What is claimed is:

1. A method for bleaching laundry using a peroxidized compound comprising bleaching laundry at a temperature of less than 70° C. for less than 30 minutes in a bath which has a pH of 10.5 to 12.5 in the presence of $1\times10^{-3}$ to $1\times10^{-2}$ gram-atom of calcium or barium per liter of bath and in the presence of a sequestrant for alkaline earth metal ions in a quantity equal or superior to that which corresponds to the amount required for complete sequestration of calcium or barium ions in solution in the bath; said calcium or the barium being introduced in the form of the oxide CAO or BaO; the hydroxide $Ca(OH)_2$ or $Ba(OH)_2$; or of a calcium or barium salt, the anion of which is inert towards hydrogen peroxide and which is accompanied by a quantity of sodium hydroxide equal to that required for the formation of calcium hydroxide or barium hydroxide.

2. The method of claim 1, wherein the bath contains at least $5\times10^{-3}$ gram-atom of calcium or barium per liter.

3. The method of claim 2, wherein the calcium or barium salt is the chloride.

TABLE I

| Example No. | Bath temperature °C. | Concentration in the bath: Sodium perborate mole/l | Washing powder g/l | 5NaDTPA mole/l | 3NaNTA mole/l | CaO mole/l | $CaCL_2$ mole/l | NaOH mole/l | $BaCl_2$ mole/l | Degree of whiteness |
|---|---|---|---|---|---|---|---|---|---|---|
| 1 | 60 | $1\times10^{-2}$ | 6.8 | | | | | $1\times10^{-2}$ | $5\times10^{-3}$ | 81.5 |
| 2 | 60 | $5\times10^{-3}$ | 6.8 | | | | $5\times10^{-3}$ | $1\times10^{-2}$ | | 78 |
| 3* | 60 | $5\times10^{-3}$ | 6.8 | | | | | | | 64.5 |
| 4 | 60 | $1.5\times10^{-2}$ | 6.8 | | | $5\times10^{-3}$ | | | | 84 |
| 5* | 60 | $1.5\times10^{-2}$ | 6.8 | | | | | | | 77.5 |
| 6 | 60 | $1\times10^{-2}$ | 2.85 | | | $2.5\times10^{-3}$ | | | | 76 |
| 7* | 60 | $1\times10^{-2}$ | 2.85 | | | | | | | 69.5 |
| 8 | 60 | $1\times10^{-2}$ | | $2.5\times10^{-3}$ | | | $5\times10^{-3}$ | $1\times10^{-2}$ | | 76.5 |
| 9 | 60 | $1\times10^{-2}$ | | | $3\times10^{-3}$ | | $5\times10^{-3}$ | $1\times10^{-2}$ | | 77.5 |
| 10 | 40 | $1\times10^{-2}$ | 13 | | | | $1\times10^{-2}$ | $2\times10^{-2}$ | | 70 |
| 11* | 40 | $1\times10^{-2}$ | 13 | | | | | | | 61 |
| 12* | 80 | $1\times10^{-2}$ | 6.8 | | | | | | | 82 |

*Examples 3, 5, 7, 11, and 12 are given by way of comparison.

4. The method of claim 3, wherein the sequestrant for calcium or barium is selected from alkali metal salts of polyphosphoric acids, alkali metal salts or polyamine-carboxylic acids, or alkali metal salts of polycarboxylic acids.

5. The method of claim 4, wherein the sequestrant for calcium ions or for barium ions is sodium tripolyphosphate.

6. The method of any one of claims 1 to 5, wherein the pH of the bath is not more than 11.5.

7. The method of any one of claims 1 to 5, wherein the temperature of the bath is at least 30° C. and the pH of the bath is not more than 11.5.

8. The method according to any one of claims 1 to 5, wherein the quantity of peroxidized bleaching agent in the bath corresponds to an active oxygen concentration of between 0.004% and 0.03% by weight.

9. The method of any one of claims 1 to 5, wherein the bath also contains a detergent, the pH is not more than 11.5, and the temperature of the bath is at least 30° C. and not more than 70° C.

10. A composition consisting essentially of a peroxidized compound for bleaching laundry; calcium or barium in the form of an oxide, hydroxide, or a salt, the anion of which is inert towards hydrogen peroxide and which is accompanied by a quantity of sodium hydroxide equal to that required for the formation of calcium or barium hydroxide respectively from this salt; and a sequestrant for alkaline earth metal ions in a quantity equal or superior to that which corresponds to the amount necessary to completely sequester the said calcium or barium ions, and a sequestrant for alkaline earth metal ions, the respective quantities of calcium or barium, of sodium hydroxide where used, and of sequestrant being such that they make it possible to prepare a bath suitable for the bleaching of laundry containing $1\times10^{-3}$ to $1\times10^{-2}$ gram-atom of calcium or barium per liter of bath.

11. The composition of claim 10 also containing a detergent in an amount sufficient to wash the laundry.

12. The composition of claim 10 or 11, wherein the calcium or barium is in the form of the chloride and the sequestrant is sodium tripolyphosphate.

* * * * *

UNITED STATES PATENT AND TRADEMARK OFFICE

CERTIFICATE OF CORRECTION

PATENT NO. : 4,810,408
DATED : March 7, 1989
INVENTOR(S) : Dubreux et al.

It is certified that error appears in the above-identified patent and that said Letters Patent is hereby corrected as shown below:

Column 6, lines 11 and 12, after ions, the words "and a sequestrant for alkaline earth metal ions," should be deleted.

Signed and Sealed this

Seventh Day of November, 1989

*Attest:*

JEFFREY M. SAMUELS

*Attesting Officer*

*Acting Commissioner of Patents and Trademarks*